US009162814B2

(12) United States Patent
Grönholm et al.

(10) Patent No.: US 9,162,814 B2
(45) Date of Patent: Oct. 20, 2015

(54) ADAPTOR PALLET

(71) Applicant: K. HARTWALL OY AB, Söderkulla (FI)

(72) Inventors: Jack Grönholm, Söderkulla (FI); Jussi Raninen, Söderkulla (FI)

(73) Assignee: K. HARTWALL OY AB, Soderkulla (FI)

( * ) Notice: Subject to any disclaimer, the term of this patent is extended or adjusted under 35 U.S.C. 154(b) by 0 days.

(21) Appl. No.: 13/912,272

(22) Filed: Jun. 7, 2013

(65) Prior Publication Data

US 2013/0327735 A1 Dec. 12, 2013

(30) Foreign Application Priority Data

Jun. 8, 2012 (EP) ..... 12171283

(51) Int. Cl.
*B65D 85/68* (2006.01)
*B65D 19/00* (2006.01)
*B65D 19/44* (2006.01)

(52) U.S. Cl.
CPC ..... *B65D 85/68* (2013.01); *B65D 19/0095* (2013.01); *B65D 19/44* (2013.01); *B65D 2519/0096* (2013.01); *B65D 2519/00273* (2013.01); *B65D 2519/00293* (2013.01); *B65D 2519/00323* (2013.01); *B65D 2519/00333* (2013.01); *B65D 2519/00815* (2013.01); *B65D 2585/686* (2013.01)

(58) Field of Classification Search
CPC ..... B65G 1/026; B65D 19/44; B65D 85/68; B65D 19/0095; B65D 2585/686; B65D 2519/00815; B65D 2519/00333; B65D 2519/00273; B65D 2519/00293; B65D 2519/0096; B65D 2519/00323
USPC ..... 211/151, 162, 126.15, 188, 194; 414/276, 286; 108/57.15; 312/201
See application file for complete search history.

(56) References Cited

U.S. PATENT DOCUMENTS

| | | | | | |
|---|---|---|---|---|---|
| 3,768,673 | A | * | 10/1973 | Nydam et al. | 414/522 |
| 3,990,557 | A | * | 11/1976 | Carder | 193/35 A |
| 4,988,251 | A | * | 1/1991 | Kinney | 414/276 |
| 5,170,896 | A | * | 12/1992 | Konstant | 211/151 |
| 5,350,270 | A | * | 9/1994 | Stallard et al. | 414/276 |

(Continued)

FOREIGN PATENT DOCUMENTS

| | | | |
|---|---|---|---|
| DE | 20 2006 007 202 | U1 | 9/2006 |
| DE | 20 2010 009390 | U1 | 10/2010 |

(Continued)

*Primary Examiner* — Joshua Rodden
*Assistant Examiner* — Hiwot Tefera
(74) *Attorney, Agent, or Firm* — Birch, Stewart, Kolasch & Birch, LLP

(57) ABSTRACT

The adaptor pallet includes two sets of parallel tracks, a lifting structure connecting the tracks at an elevated level, a loading end for introducing dollies to the adapter pallet, and a closed end including a stopper for limiting the movement of dollies. The adaptor pallet further includes a locking plate which is rotatably connected to the lifting structure at one end, while another end of the locking plate includes a stopper protrusion and a member for releasably affixing the locking plate into a horizontal position such that the stopper protrusion limits the movement of the dollies at the loading end of the adaptor pallet, wherein the locking plate is releasable from the horizontal position into an angled position for opening the loading end of the adaptor pallet.

22 Claims, 6 Drawing Sheets

(56) References Cited

U.S. PATENT DOCUMENTS

| | | | | |
|---|---|---|---|---|
| 5,618,152 | A * | 4/1997 | Andrews | 414/546 |
| 5,720,489 | A * | 2/1998 | Pierce et al. | 280/149.2 |
| 6,390,759 | B1 * | 5/2002 | Novak et al. | 414/430 |
| 7,549,518 | B2 * | 6/2009 | Pennington | 188/31 |
| 7,770,903 | B2 * | 8/2010 | Konstant | 280/33.997 |
| 7,874,568 | B1 * | 1/2011 | Pelligrino | 280/414.1 |
| 8,444,366 | B2 * | 5/2013 | Cole | 414/607 |
| 2010/0310352 | A1 | 12/2010 | Moberg | |

FOREIGN PATENT DOCUMENTS

| | | | |
|---|---|---|---|
| DE | 10 2009 052869 | A1 | 5/2011 |
| DE | 20 2011 106718 | U1 | 3/2012 |
| GB | 2 416 527 | A | 2/2006 |

* cited by examiner

ADAPTOR PALLET

FIELD OF THE INVENTION

The present invention relates to an adaptor pallet for transporting and storing a plurality of wheeled dollies.

BACKGROUND ART

Goods of relatively small size are typically transported using wheeled dollies which are platforms mounted on wheels or castors. Goods are stored in containers that fit into the receptive platform. Upon transportation or temporary storage, the usually boxlike containers are stacked onto dollies whose wheels enable easy handling by hand. The shape and size of the dollies are usually standardized to conform advantageously to industrial container models. While the dollies may be moved about by hand, there is also a need to transport a plurality of dollies at once. Such a need occurs e.g. when loading or unloading a trailer or a lorry. If a trailer is loaded dolly by dolly, the long duration of the operation consumes valuable docking time not to mention inflicted gratuitous vehicle idle time. Also, when transported individually, the dollies require thorough and tedious trussing up to prevent unintended movement within the load space. To tackle these disadvantages, adaptor pallets have been developed. These adaptor pallets are usually rather flat and include a deck that has an upper support surface to accommodate a plurality of wheeled dollies, tracks to guide the dolly wheels, means for supporting the deck a certain distance above ground, receptive slots to receive the lifting forks of a forklift.

There is also a need to secure the dollies to the adaptor pallet. Many different securing devices have been developed over time but existing securing methods may be divided into two main types. The first type is an adaptor pallet having an open loading end, whereby the dollies are secured to the pallet by operating special locking fins or similar locking elements which are toggled between locked and released position by manipulation means which may take the form of a foot-operated lever or a hand-operated handle. A foot-operated lever is preferred for leaving the operator's hand free to manipulate the loaded dolly. While the open end type adaptor pallet is advantageous in that it is easy to use, the manipulation system for toggling the locking elements may be quite complex making the adaptor pallet expensive to make and buy as well as heavy and eventually vulnerable to failure. As adaptor pallets are used in logistics, it is paramount that the appropriate tools are as robust and reliable as possible but also easy to use.

The second type of is a closed end adaptor pallet which does not feature separate locking and manipulation means but a simple ramp which may pivoted down for loading the pallet and up for closing the loading end of the pallet. Such a pallet is disclosed in DE 20 2006 007 202 U1. The second type of adaptor pallets is indeed very light and robust but it suffers from awkward user interface in that the locking ramp must be operated by hand, wherein a combined rotation and lifting motion is required to negotiate the ramp. Accordingly, the operator must dedicate at least one hand to securing the cargo while holding the dolly stationary with the other hand while crouching down.

AIM OF THE INVENTION

It is therefore an aim of the present invention to provide a light and robust adapter pallet which is also easy to use.

SUMMARY

The aim of the present invention is achieved by virtue of a novel adaptor pallet for the transport of dollies. The novel adaptor pallet comprises two sets of parallel tracks for receiving the wheels of a dolly, which tracks define a longitudinal direction. Between both sets of tracks, a lifting structure is arranged to connect the tracks at an elevated level for receiving the lifting forks of a fork-lift. The adaptor pallet also comprises a loading end for introducing the dollies to the adapter pallet, and a closed end which opposes the loading end in the longitudinal direction and comprises a stopper for limiting the movement of dollies in the longitudinal direction. The novel adaptor pallet further comprises a locking plate for limiting the movement of the dollies in the longitudinal direction. The locking plate is rotatably connected to the lifting structure at one end, while another end of the locking plate comprises a stopper protrusion and means for releasably affixing the locking plate into a horizontal position such that the stopper protrusion limits the movement of the dollies at the loading end of the adaptor pallet, wherein the locking plate is releasable from the horizontal position into an angled position for opening the loading end of the adaptor pallet.

Considerable benefits are gained with aid of the present invention. Due to the novel releasable locking structure combined with a separate pivoting attachment between the locking plate and the lifting structure of the pallet, the frames of the dolly may be secured to the pallet without reaching down to negotiate a ramp with a combined pivoting and locking guides according to the prior art. On the other hand, the proposed locking structure may be provided without separate manipulation means, whereby the structure is very robust and light.

According to one embodiment, the means for releasably affixing the locking plate into a horizontal position comprises a latch which is suspended to the locking plate and configured to slide in and out of a slot arranged in a longitudinal beam of the lifting structure for securing the locking plate into and releasing it from the horizontal locking position. The suspension makes it possible to bias the latch such that it may be released from the locking position by operating the latch directly by foot, for example. As the latch is suspended in relation to the locking plate, no external manipulation means are necessary.

According to one embodiment, the rotation joint between the locking plate and the lifting structure of the pallet is provided to the end of the locking plate farthest from the loading end of the adaptor pallet, whereas the latch is provided to the end of the locking plate nearest to the loading end of the adaptor pallet and opposing the rotation joint. With such a configuration the locking plate is adapted to pivot such that the locking protrusion of the locking plate can pivot down at the loading end of the pallet for allowing dollies to be loaded onto the pallet. As a result, the locking plates may be locked into a horizontal locking position by lifting them up from the loading end. This yields a particularly advantageous effect of being able to lock the dollies into place with one lifting motion by inserting the lifting forks of a forklift under the lifting structures and lifting said forks, whereby the locking plates automatically snap into locking position.

BRIEF DESCRIPTION OF DRAWINGS

In the following, embodiments of the present invention are discussed in greater detail with reference to the accompanying drawings in which.

DETAILED DESCRIPTION OF EXEMPLARY EMBODIMENTS

Figure 1:
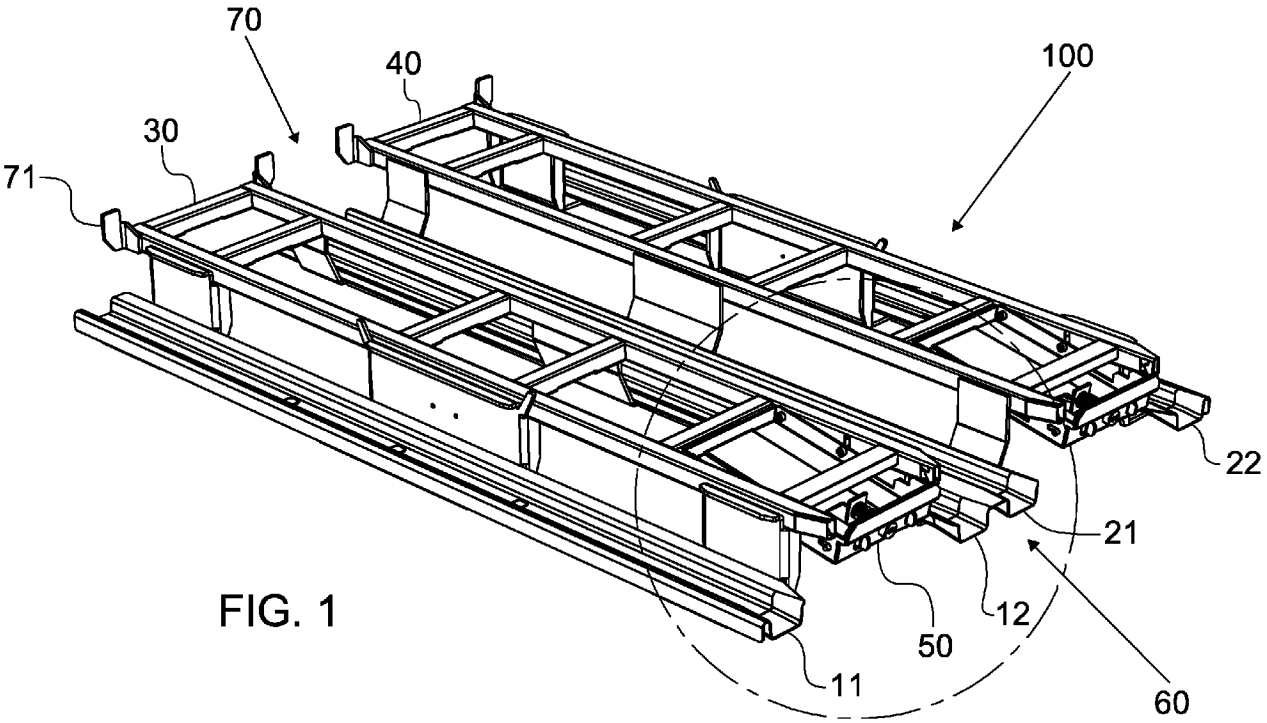
FIG. 1 presents an elevated isometric view of an adaptor pallet according to one embodiment.

FIG. 1 shows an overview of an empty adaptor pallet 100 according to one embodiment in an open, i.e. not locked, position. The adaptor pallet 100 includes a first set of parallel tracks 11, 12 for receiving the wheels of a first plurality of dollies. The tracks define a longitudinal direction in which the dollies are intended to be loaded and unloaded. The tracks 11, 12 are formed as grooves having a cross-section resembling the letter U which provides adequate lateral support for the wheels of the dolly. The deepness of the grooves of the tracks 11, 12 also aids in guiding the wheels thereby reducing their tendency to turn sideways to the longitudinal direction.

Figure 2:
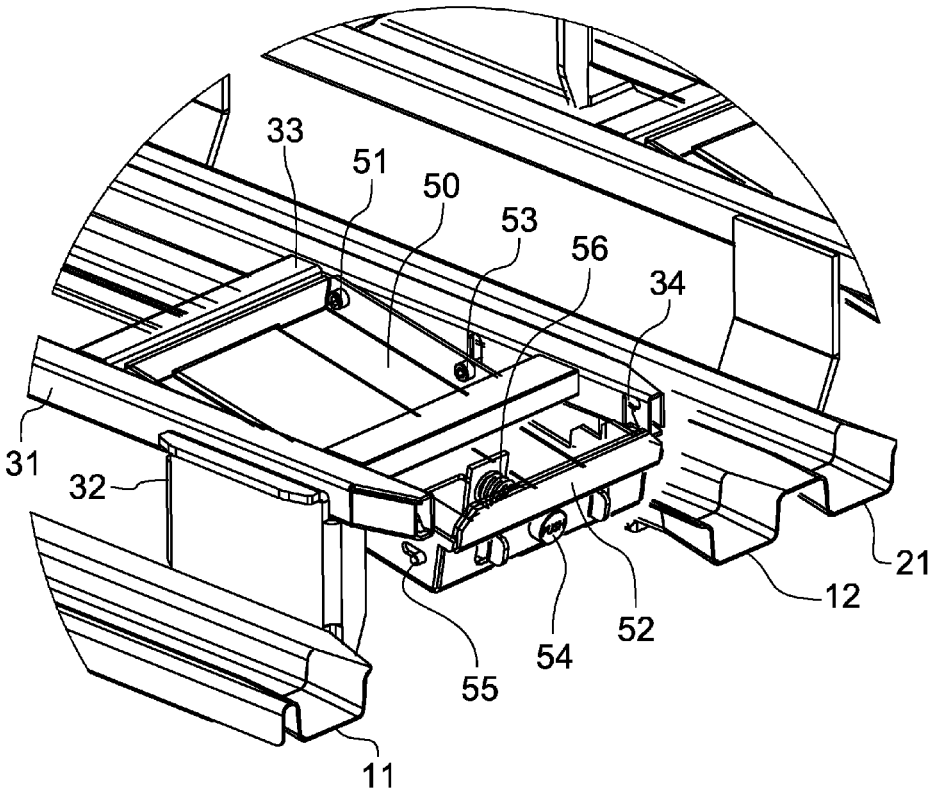
FIG. 2 presents a detailed view of the locking means being highlighted by a dash lined circle in FIG. 1.

A first lifting structure 30 is arranged between the first set of tracks 11, 12 at an elevated level from the tracks 11, 12. The lifting structure 30 is provided in the form an upwardly extending tunnel for receiving the lifting forks of a fork-lift. FIG. 2 shows the construction of the lifting structure 30 in detail. The lifting structure 30 has vertical supports 32 extending upward from both tracks 11, 12 and longitudinal beams 31 running in the longitudinal direction and connecting the upper ends of the vertical supports 32, whereby the longitudinal beams 31 are elevated from the tracks 11, 12. The longitudinal beams 31 are connected by transversal beams 33 which are also elevated from the tracks 11, 12 by the extension of the vertical supports 32. The elevated transversal beams 33 are configured to engage with the lifting forks of a forklift or similar lifting means for lifting the adaptor pallet 100. On the other hand, the transversal beams 33 are used to further secure the cargo to the pallet by providing vertical support for lashing belts.

Referring back to FIG. 1 which shows that attached to the inner track 12 of the first set of tracks is a second set of parallel tracks 21, 22 for receiving the wheels of another plurality of dollies. The second set of parallel tracks 21, 22 is arranged parallel to the first set of tracks 11, 12. The second set of tracks 21, 22 is provided with a second lifting structure 40 which connecting the second set of tracks 21, 22 similarly as the first lifting structure 30 connects the first set of tracks 11, 12.

FIG. 1 also shows the loading end 60 of the pallet 100 for introduction of dollies. The loading end 60 is shaped such to accommodate easy loading movement of the dollies. For example, the tracks 11, 12, 21, 22 are flared towards the loading end 60 to better receive the wheels of a dolly. Also, longitudinal beams 31 (FIG. 2) are wedged at the loading end 60. The adaptor pallet 100 further features a closed end 70 which opposes the loading end 60 in the longitudinal direction. The closed end 70 includes a stopper 71 which is configured to limit the movement of dollies 200 in the longitudinal direction. In the illustrated example, the lifting structures 30, 40 are at the closing end 70 equipped with stoppers 71 taking the form of plates configured to engage with the chassis of a dolly 200A, 200B loaded to the farthermost loading position of the adaptor pallet 100 (cf. FIGS. 3 and 6.

Figure 4:
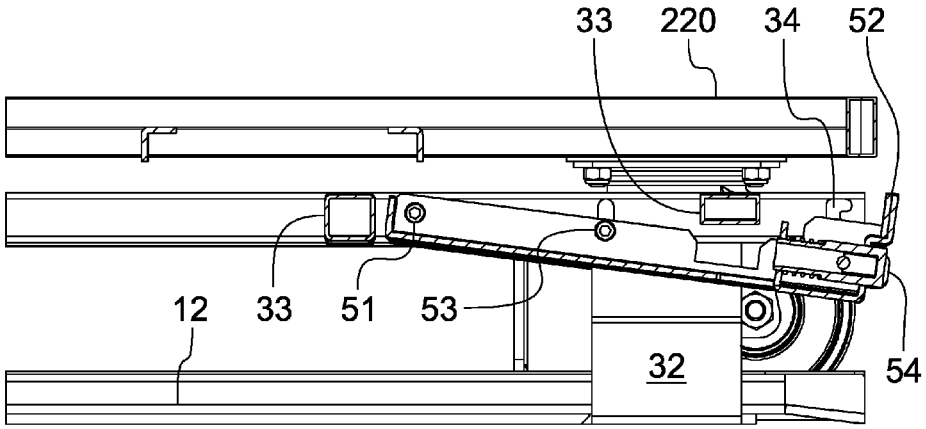
FIG. 4 presents a cross-sectional view of released locking means as illustrated in FIGS. 1 to 3.
Figure 5:
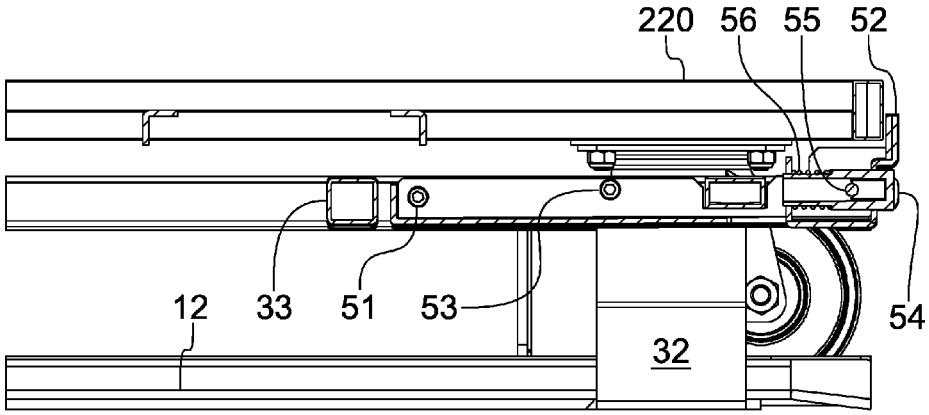
FIG. 5 presents a cross-sectional view of the locking means of FIG. 4 in secured configuration.

Referring now to FIGS. 2, 4 and 5 which show a detailed view locking means which is arranged to the loading end 60 of the adapter pallet 100 for limiting the movement of the dollies 200 in the longitudinal direction, i.e. securing the dollies to the pallet. The locking means includes a locking plate 50 which is shaped as a open shallow case. The rear end of the locking plate 50 is rotatably connected to the lifting structure 30, 40. More specifically, the end of the locking plate 50 closer to the closed end 70 of the pallet 100 is pivoted between the longitudinal beams 31 of the lifting structure 30. The rotation joint 51 is established by a pin, screw or similar arranged to rotatable connect the vertical wall of the locking plate 50 to a receptive opening in the corresponding vertical face of the longitudinal beam 31. The locking plate 50 is other words rotatably connected to between two longitudinal beams 31 of the lifting structure 30 by means of a rotation joint 51 which is arranged to pivot the locking plate 50 in respect to the longitudinal beam 31 about a horizontal rotation axis is transverse in respect to the longitudinal direction. The rotation movement is limited by a vertical angle limiter 53 which is a similar pin, screw or similar as the rotation join 51 but arranged to slide in the vertical direction in a corresponding slot provided to the longitudinal beam 31. The vertical angle limiter 53 thus limits the rotation angle of the locking plate 50.

The front end, i.e. the end closer to the loading end of the adaptor pallet 100, of the locking plate 50 is equipped with a stopper protrusion 52. The stopper protrusion 52 extends vertically from the locking plate 50 and is configured to engage with the chassis 220 of a dolly 200 to limit movement thereof in the longitudinal direction of the adaptor pallet 100. The stopper protrusion 52 is in other words configured to block the loading end 60 of the adaptor pallet 100.

FIGS. 2, 4 and 5 further show means for releasably affixing the locking plate 50 into a horizontal position, wherein the stopper protrusion 52 limits the movement of the dollies 200 at the loading end 60 of the adaptor pallet 100. Said Figures illustrate said means enabling the locking plate 50 to be released from the horizontal position (FIG. 4) into an angled position (FIG. 5) for opening the loading end 60 of the adaptor pallet 100 for loading or unloading. In the illustrated example, said means for releasably affixing the locking plate 50 into a horizontal position includes a latch 55 which is suspended to the locking plate 50. The latch 55 is provided to the front end of the locking plate 50 which is nearest to the loading end 60 of the adaptor pallet 100 and opposing the rotation joint 51. The latch 55 is configured to slide in and out of a slot 34 arranged in the longitudinal beam 31. The slot 34 is shaped to resemble a reversed number one such that the slot has a horizontal extension for securing the latch 55 and thus the locking plate 50 into the horizontal position and a vertical extension for releasing the latch 55 from the beam 31 and thus releasing the plate 50 from the horizontal locking position.

As briefly mentioned above, the latch 55 is suspended to the locking plate 50 for biasing the latch 55 into the locked position, i.e. towards the end of the horizontal portion of the slot 34. The latch 55 is connected to a release button 46 through a linkage (not shown) including a longitudinal portion extending rearwards from the button 46 and branching transversally as two protuberances making up the latch. A bias spring 56 is arranged between the locking plate frame and latch linkage. More specifically, the bias spring 56 is arranged between a vertical frame extension of the locking plate 50 and the transverse portions of the latch linkage. Accordingly, the bias spring 56 is configured to bias the latch 55 to locked position, i.e. forwards in the horizontal portion of the slot 34. The arrangement is therefore configured to release the latch 55 from locked position the release button 46 is depressed enough to exceed the springback factor of the bias spring 56.

The locking plate 50 as described above may be enhanced by selecting the color of the plate to aid user-friendliness. For example, the frontal face of the stopper protrusion 52 may be painted in a color which has a strong contrast to the color of the upper face of the locking plate 50. For example, the frontal face of the stopper protrusion 50 may be painted red while the upper face of the locking plate 50 may be green, whereby the position of the locking plate 50 is clearly visible from the visual clues arranged by means of the color scheme.

The above described example may be varied without departing from inventive concept as defined in the appended independent claim. For example, the rotation joint may be provided differently compared to the embodiments above. An alternative possibility would be to pivot the locking plate 50 about a longitudinal axis, i.e. in respect to the longitudinal beam 31, wherein it is not the end of the locking plate 50 nearest to the loading end 60 of the adaptor pallet 100 which is deviated from the horizontal position, but the end opposing the end hinged to a longitudinal beam 31. Also, instead of a release button 46, the latch of the locking plate 50 may be operated by another type of interface, such as a handle which is configured to deviate the latch.

The operation of the described adaptor pallet is described in the following.

Figure 7:
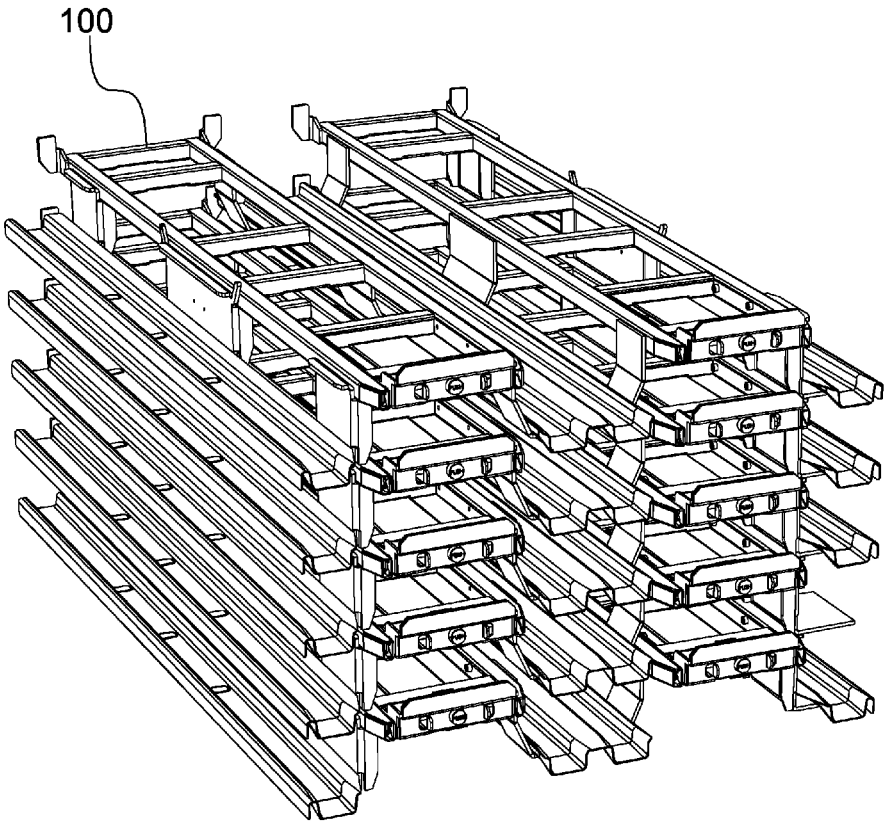
FIG. 7 presents a stack of vacant adaptor pallets of FIG. 1.

Empty adaptor pallets 100 may be stored in a stacked formation as illustrated in FIG. 7. When stacked, the locking plates may be in locked horizontal position or in open angled position. The adaptor pallet 100 is designed such that the longitudinal beam 31 of a lower pallet supports the lower end of the vertical support 32 of the lifting structure 30 of an upper pallet. Tracks of superposed pallets have therefore enough space adjacent to the superposed lifting structures. As the locking plates are kept under transverse beams 33 of the lifting structure, superposed pallets subject no load to the locking plate mechanism, which is a great improvement compared to traditional upwardly protruding locking means. If the upper face of the locking plate 50 is painted in different color than the front face of the locking protrusion 52 as explained above, it is easy for the operator to visually detect the state of the adaptor pallet 100 from a distance.

When loading an empty adaptor pallet 100, the locking plate 50 is first released from the locking position, i.e. from horizontal orientation, by depressing the release button 54 which is kept in locked position by the bias spring 56 pushing the button 54 outwards. The biasing is limited by the length of the horizontal portion of the slot 34 in the longitudinal beam 31. The inward directed movement of the release button 54 is transmitted to the latch 55 through the transverse linkage combining the two. When the pushing force exceeds the springback factor of the bias spring 56, the latch 55 is retracted from the front end of the horizontal portion of the slot 34 in the longitudinal beam 31, wherein the latch 55 is free to drop from said slot 34 along the vertical portion thereof. As a result, the locking plate 50 pivots around the rotation joint 51, wherein the movement is limited by the vertical angle limiter 53 arranged between the latch 55 and the rotation joint 51. When the locking plate 50 has dropped into the angled open position, the locking protrusion 52 has descended such that there is no obstacle blocking the entry to the adaptor pallet 100, whereby dollies 200 may be loaded onto the pallet (FIGS. 1 and 2).

Figure 3:
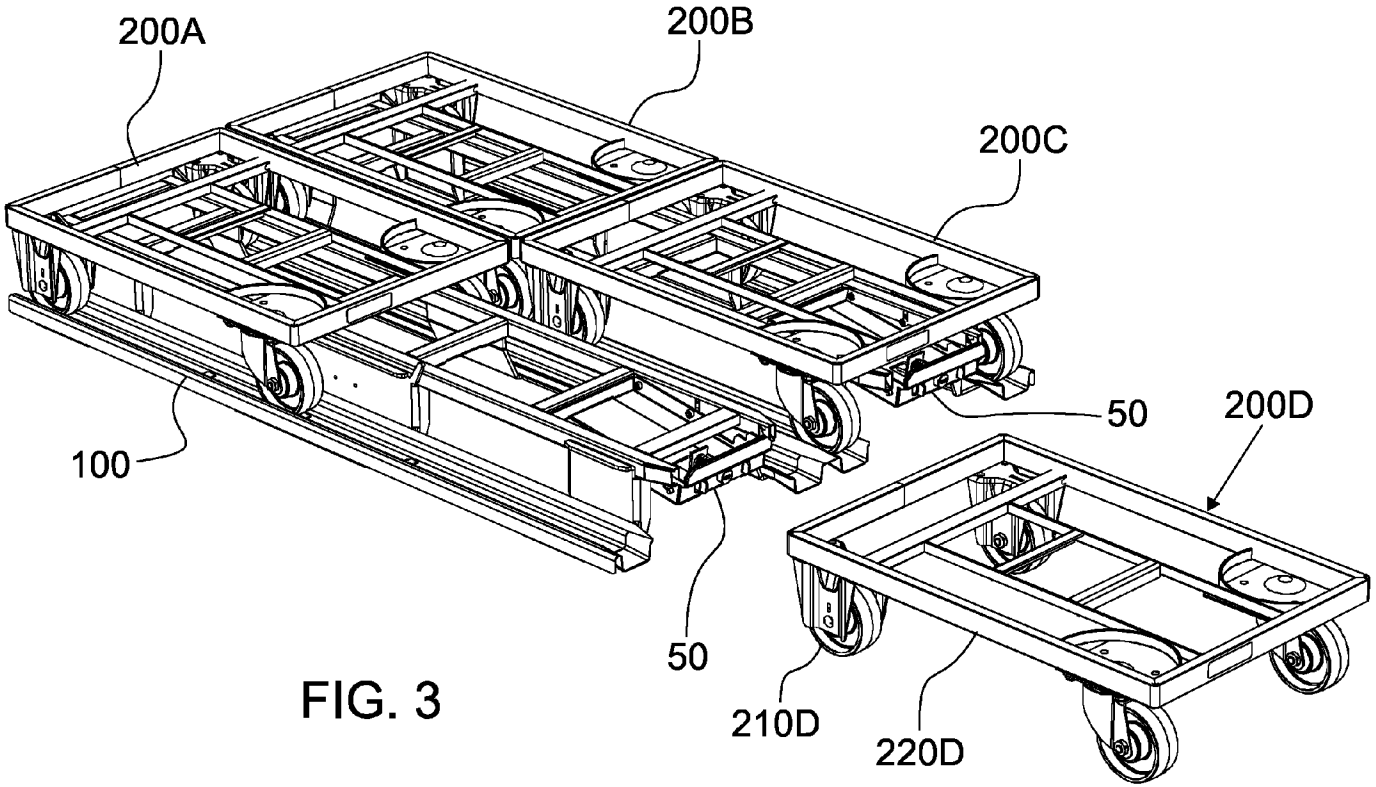
FIG. 3 presents the adaptor pallet of FIG. 1 with three occupied positions while having a vacant position for one dolly to be loaded.
Figure 6:
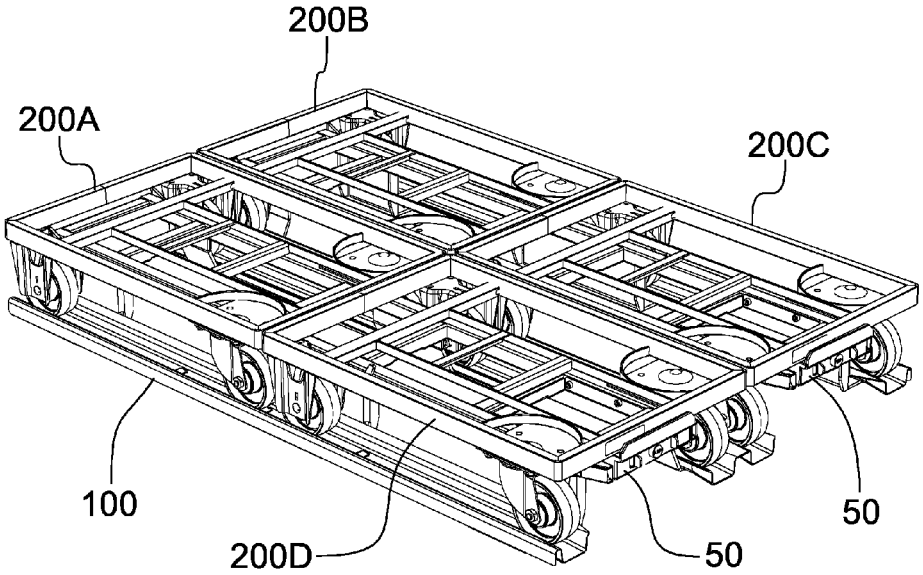
FIG. 6 presents the adaptor pallet of FIG. 3 with all positions occupied and the locking means in secured configuration as shown in FIG. 5.

FIGS. 3 to 5 show an example of an adaptor pallet 100 configured to receive four dollies 200A to 200D. In FIG. 3, three dollies 200A to 200C have been loaded onto the adaptor pallet 100, while the locking plates 50 are open to receive the last dolly 200D. FIG. 4 shows a detail view of the locking plate 50 and the final dolly 200 before closing the locking means. The open or released locking plate 50 may be simply lifted up by hand or foot. Alternatively, the adaptor pallet 100 may be locked by inserting the lifting forks of a forklift under the locking plates 50 and lifting the forks, whereby the locking plates 50 are locked into horizontal position automatically as the bias spring 56 pushes the latch 55 into place (FIGS. 5 and 6).

Thus, while there have been shown and described and pointed out fundamental novel features of the invention as applied to one embodiment thereof, it will be understood that various omissions and substitutions and changes in the form and details of the adaptor pallet may be made by those skilled in the art without departing from the spirit of the invention. For example, it is expressly intended that all combinations of those elements which perform substantially the same results are within the scope of the invention. Substitutions of the elements from one described embodiment to another are also fully intended and contemplated. It is also to be understood that the drawings are not necessarily drawn to scale but they are merely conceptual in nature. It is the intention, therefore, to be limited only as indicated by the scope of the claims appended hereto.

TABLE 1

LIST OF REFERENCE NUMBERS.

| Number | Part |
|---|---|
| 11 | track |
| 12 | track |
| 21 | track |
| 22 | track |
| 30 | first lifting structure |
| 31 | longitudinal beam |
| 32 | vertical support |
| 33 | transversal beam |
| 34 | slot |
| 40 | second lifting structure |
| 50 | locking plate |
| 51 | rotation joint |
| 52 | locking protrusion |
| 53 | vertical angle limiter |
| 54 | release button |
| 55 | latch |
| 56 | bias spring |
| 60 | loading end |
| 70 | closed end |
| 71 | stopper |
| 100 | adaptor pallet |
| 200 | dolly |
| 210 | wheel |
| 220 | chassis |

The invention claimed is:

1. Adaptor pallet for the transport of dollies, the adaptor pallet comprising:

a first set of parallel tracks for receiving the wheels of a dolly, which tracks define a longitudinal direction, a first lifting structure connecting the first set of tracks at an elevated level from the tracks for receiving the lifting forks of a forklift, a second set of parallel tracks for receiving the wheels of another dolly, the second set of parallel tracks being arranged parallel to the first set, a second lifting structure connecting the second set of tracks at an elevated level from the tracks, a loading end for introducing the dollies to the adapter pallet, a closed end opposing the loading end in the longitudinal direction and comprising a stopper for limiting the movement of dollies in the longitudinal direction, and locking means arranged to the loading end of the adapter pallet for limiting the movement of the dollies in the longitudinal direction, the locking means comprising a locking housing, one end of which locking housing is rotatably connected to the lifting structure, and another end of which locking housing comprising a stopper protrusion and means for releasably affixing the locking housing into a horizontal position in which horizontal position of the locking housing the stopper protrusion limits the movement of the dollies at the loading end of the adaptor pallet and wherein the locking housing is releasable from the horizontal position into an angled position for opening the loading end of the adaptor pallet.

2. Adaptor pallet according to claim 1, wherein the lifting structure comprises longitudinal beams arranged parallel to the tracks and elevated there from by vertical supports connecting the longitudinal beams to the tracks, wherein the locking housing is arranged between two longitudinal beams of the lifting structure, wherein the locking housing is elevated from the level of the tracks.

3. Adaptor pallet according to claim 2, wherein said means for releasably affixing the locking housing into a horizontal position comprises a latch which is suspended to the locking housing and configured to slide in and out of a slot arranged in the longitudinal beam of the lifting structure for securing the locking housing into and releasing it from the horizontal locking position.

4. Adaptor pallet according to claim 2, wherein locking housing is rotatably connected to between two longitudinal beams of the lifting structure by means of a rotation joint.

5. Adaptor pallet according to claim 4, wherein the rotation joint comprises at least one pin, such as a screw, arranged to pivot the locking housing in respect to the longitudinal beam about a horizontal axis of the pin, wherein the longitudinal beam is provided with a corresponding opening for the pin.

6. Adaptor pallet according to claim 5, wherein the rotation joint is arranged such that the horizontal rotation axis is transverse in respect to the longitudinal direction.

7. Adaptor pallet according to claim 4, wherein the rotation joint is provided to the end of the locking housing farthest from the loading end of the adaptor pallet.

8. Adaptor pallet according to claim 3, wherein the latch being provided to the end of the locking housing nearest to the loading end of the adaptor pallet and opposing a rotation joint.

9. Adaptor pallet according to claim 3, wherein the locking housing comprises:

a release button which is connected to the latch via a linkage for manipulation of a latch and a bias spring which is arranged between a locking housing frame and latch linkage and which bias spring is configured to bias the latch to locked position, whereby a pushing movement of the release button exceeding the springback factor of the bias spring is configured to release the latch from locked position.

10. Adaptor pallet according to claim 1, wherein the stopper protrusion of the locking housing is configured to engage with a frame of a dolly, when the locking housing is in a horizontal position.

11. Adaptor pallet according to claim 4, wherein the rotation joint is arranged such that a horizontal rotation axis is transverse in respect to the longitudinal direction.

12. Adaptor pallet according to claim 5, wherein the rotation joint is provided to the end of the locking housing farthest from the loading end of the adaptor pallet.

13. Adaptor pallet according to claim 6, wherein the rotation joint is provided to the end of the locking housing farthest from the loading end of the adaptor pallet.

14. Adaptor pallet according to claim 4, wherein a latch being provided to the end of the locking housing nearest to the loading end of the adaptor pallet and opposing the rotation joint.

15. Adaptor pallet according to claim 5, wherein a latch being provided to the end of the locking housing nearest to the loading end of the adaptor pallet and opposing the rotation joint.

16. Adaptor pallet according to claim 6, wherein a latch being provided to the end of the locking housing nearest to the loading end of the adaptor pallet and opposing the rotation joint.

17. Adaptor pallet according to claim 7, wherein a latch being provided to the end of the locking housing nearest to the loading end of the adaptor pallet and opposing the rotation joint.

18. Adaptor pallet according to claim 4, wherein the locking housing comprises:

a release button which is connected to a latch via a linkage for manipulation of the latch and a bias spring which is arranged between a locking housing frame and latch linkage and which bias spring is configured to bias the latch to locked position, whereby a pushing movement of the release button exceeding the springback factor of the bias spring is configured to release the latch from locked position.

19. Adaptor pallet according to claim 5, wherein the locking housing comprises:

a release button which is connected to a latch via a linkage for manipulation of the latch and a bias spring which is arranged between a locking housing frame and latch linkage and which bias spring is configured to bias the latch to locked position, whereby a pushing movement of the release button exceeding the springback factor of the bias spring is configured to release the latch from locked position.

20. Adaptor pallet according to claim 6, wherein the locking housing comprises:

a release button which is connected to a latch via a linkage for manipulation of the latch and a bias spring which is arranged between a locking housing frame and latch linkage and which bias spring is configured to bias the latch to locked position, whereby a pushing movement of the release button exceeding the springback factor of the bias spring is configured to release the latch from locked position.

21. Adaptor pallet for the transport of dollies, the adaptor pallet comprising:

a first set of parallel tracks for receiving the wheels of a dolly, which tracks define a longitudinal direction, a first lifting structure connecting the first set of tracks at an elevated level from the tracks for receiving the lifting forks of a forklift, a second set of parallel tracks for receiving the wheels of another dolly, the second set of parallel tracks being arranged parallel to the first set, a second lifting structure connecting the second set of tracks at an elevated level from the tracks, a loading end for introducing the dollies to the adapter pallet, a closed end opposing the loading end in the longitudinal direction and comprising a stopper for limiting the movement of dollies in the longitudinal direction, and locking means arranged to the loading end of the adapter pallet for limiting the movement of the dollies in the longitudinal direction, the locking means comprising a locking housing, one end of which locking housing is rotatably connected to the lifting structure, and another end of which locking housing comprising a stopper protrusion and means for releasably affixing the locking housing into a horizontal position in which horizontal position of the locking housing the stopper protrusion limits the movement of the dollies at the loading end of the adaptor pallet and wherein the locking housing is releasable from the horizontal position wherein the stopper protrusion is below the horizontal position for opening the loading end of the adaptor pallet for enabling the discharge of dollies from the adapter pallet.

22. Adaptor pallet for the transport of dollies, the adaptor pallet comprising:

a first set of parallel tracks for receiving the wheels of a dolly, which tracks define a longitudinal direction, a first lifting structure connecting the first set of tracks at an elevated level from the tracks for receiving the lifting forks of a forklift, a second set of parallel tracks for receiving the wheels of another dolly, the second set of parallel tracks being arranged parallel to the first set, a second lifting structure connecting the second set of tracks at an elevated level from the tracks, a loading end for introducing the dollies to the adapter pallet, a closed end opposing the loading end in the longitudinal direction and comprising a stopper for limiting the movement of dollies in the longitudinal direction, and locking means arranged to the loading end of the adapter pallet for limiting the movement of the dollies in the longitudinal direction, the locking means comprising a locking housing, one end of which locking housing is rotatably connected to the lifting structure, and another end of which locking housing comprising a stopper protrusion and means for releasably affixing the locking housing into a horizontal position in which horizontal position of the locking housing the stopper protrusion prevents the movement of the dollies at the loading end of the adaptor pallet and wherein the locking housing is releasable from the horizontal position into an angled position for opening the loading end of the adaptor pallet for enabling the discharge of dollies from the adapter pallet.

* * * * *